US008316587B2

(12) United States Patent
Shugart

(10) Patent No.: US 8,316,587 B2
(45) Date of Patent: Nov. 27, 2012

(54) EAVES PROTECTOR

(75) Inventor: Roger F. Shugart, Calera, AL (US)

(73) Assignee: Quality Edge, Inc., Walker, MI (US)

( * ) Notice: Subject to any disclaimer, the term of this patent is extended or adjusted under 35 U.S.C. 154(b) by 0 days.

(21) Appl. No.: 13/293,540

(22) Filed: Nov. 10, 2011

(65) Prior Publication Data

US 2012/0102849 A1 May 3, 2012

Related U.S. Application Data

(63) Continuation-in-part of application No. 12/748,734, filed on Mar. 29, 2010, now abandoned.

(51) Int. Cl.
*E04D 13/158* (2006.01)

(52) U.S. Cl. ..... 52/96; 52/60; 52/94; 52/95

(58) Field of Classification Search ..... 52/60, 94–97, 52/287.1

See application file for complete search history.

(56) References Cited

U.S. PATENT DOCUMENTS

| | | | | |
|---|---|---|---|---|
| 3,098,322 | A | 7/1963 | Greene | |
| 3,181,275 | A | 5/1965 | Schroter et al. | |
| 3,344,561 | A | 10/1967 | Anderson | |
| 3,344,562 | A | 10/1967 | Miles et al. | |
| 3,344,563 | A | 10/1967 | Miles et al. | |
| 3,344,566 | A | 10/1967 | Miles et al. | |
| 4,109,428 | A | 8/1978 | Aarons | |
| 4,339,898 | A | 7/1982 | Pichette | |
| 4,347,691 | A | 9/1982 | Lloyd-Jones | |
| 4,461,128 | A | 7/1984 | Knoebl | |
| 5,090,174 | A * | 2/1992 | Fragale | 52/309.9 |
| 5,195,283 | A | 3/1993 | MacLeod et al. | |
| 5,243,793 | A | 9/1993 | MacLeod et al. | |
| 5,560,158 | A | 10/1996 | Norton | |
| 5,657,585 | A | 8/1997 | Zaccagni | |
| 5,711,117 | A | 1/1998 | Zaccagni et al. | |
| 5,729,933 | A | 3/1998 | Strength | |
| 5,735,084 | A | 4/1998 | Zaccagni et al. | |
| 5,797,220 | A | 8/1998 | Zaccagni | |
| 7,318,282 | B2 | 1/2008 | Pulte | |
| 7,367,163 | B2 | 5/2008 | Brochu et al. | |
| 7,614,152 | B2 | 11/2009 | Pulte | |
| 7,823,336 | B2 | 11/2010 | Brochu et al. | |
| 2003/0177717 | A1 | 9/2003 | Gatherum | |
| 2004/0103592 | A1 | 6/2004 | Edvardsen | |
| 2005/0223657 | A1 | 10/2005 | Brochu et al. | |
| 2008/0016806 | A1 | 1/2008 | Pulte | |
| 2008/0072503 | A1 | 3/2008 | Brochu et al. | |
| 2010/0212234 | A1 | 8/2010 | Monteer | |

FOREIGN PATENT DOCUMENTS

| | | |
|---|---|---|
| JP | 406299647 | 10/1994 |
| JP | 2003328516 | 11/2003 |

* cited by examiner

*Primary Examiner* — Robert Canfield
(74) *Attorney, Agent, or Firm* — Price Heneveld LLP

(57) ABSTRACT

An eaves protector includes a soffit receiver and a soffit/fascia lock which are fastened to the eaves. A fascia plate and a soffit panel are engaged to the soffit receiver and the fascia/soffit lock. Some versions of the eaves protector require no fasteners to keep the soffit and fascia plate in place. The eaves protector can be simply and inexpensively manufactured from single pieces of folded material, and may be manufactured to standard dimensions that will fit any building, or custom-cut on site.

39 Claims, 3 Drawing Sheets

EAVES PROTECTOR

CROSS-REFERENCE TO RELATED APPLICATIONS AND CLAIM TO PRIORITY

The present application is a continuation-in-part of commonly assigned, U.S. patent application Ser. No. 12/748,734, filed Mar. 29, 2010, entitled EAVES PROTECTOR, which is now abandoned and hereby incorporated herein by reference, and claims priority thereto under 35 U.S.C. §120.

BACKGROUND

A. Field of the Disclosure

The present disclosure relates generally to the construction of buildings, and more specifically to eaves protectors and methods of using the same.

B. Background

The eaves of a building is the area where the roof overhangs the exterior wall. Although the upper surface of the roof and the main body of the exterior wall are generally well protected from the elements, where they meet at the eaves both structures are vulnerable to weathering. Typically the fascia board, which extends from the edge of the roof down to cover the edges of the rafters, will either be painted or plated to protect the wood from rain, freezing, and sunlight. Plating with a layer of protective material (such as metal or vinyl) has the advantage of greater durability than painting, although it is more material and labor intensive. The area below the roof is also vulnerable to weathering, and is typically protected by a soffit. Soffits are made from a variety of construction materials, including polymer, metal, and painted wood.

Although the use of a protective layer of material over the eaves has many recognized advantages over alternative methods (such as applying protective paint to the structures forming the eaves), such systems are subject to persistent problems that have never been adequately solved. The materials used are expensive compared to paints and finishes. The cost is compounded by the fact that buildings (and their eaves) are not of a single standard design, and components of eaves protection systems must be custom-manufactured to fit a given building. Consequently, there is a long-felt but unmet need in the art for an eaves protector composed mostly or entirely of standardized parts that need not be custom manufactured for each building, or which can be easily custom-cut at the work site.

Unlike paint, protective structures must be fastened to the building. The presence of fastener holes can create conduits for moisture to enter the eaves through the protective structures, damaging the eaves and potentially corroding the protective structure itself if it is not adequately resistant to moisture. In addition, the inevitable daily and seasonal changes in temperature to which the protective structures will be subjected cause such structures to expand and contract, changing in size and shape. Such expansion and contraction will put stress on fasteners, widening fastener holes and slowly working fasteners loose. The larger the component, the greater the change in size and shape that will occur as a result of changes in temperature. Lastly, driving fasteners is a very labor-intensive step in installing an eaves protector. Consequently, there is a long-felt but unmet need in the art for an eaves protector in which the largest components (the soffit and the fascia plate) require no fasteners, and in which the largest components can expand and contract freely without detaching from the building or from the rest of the system.

Protective structures covering the eaves are typically composed of at least some parts that require extrusion, welding, soldering, or other joining techniques during manufacture. The requirement for such techniques increases the cost of the part, and thus the cost of the system as a whole. Consequently, there is a long-felt but unmet need in the art for an eaves protector the components of which require no joining, and can be made by simple manufacturing techniques (for example, merely folding the material into the needed shape).

Whereas painting the eaves retains the shape and appearance of traditional wood construction, including a distinct fascia board, soffit, and frieze board, protective structures such as siding and eaves protectors cover this aesthetically pleasing construction. As a result, currently used eaves protectors are not aesthetically pleasing, and are considered by many to impart a "cheap" appearance to the building, despite the fact that they provide superior weathering protection and are not inexpensive. Consequently, there is a long-felt but unmet need in the art for an eaves protector that provides superior weathering protection and retains the appearance of wood construction when installed.

SUMMARY

An eaves protector is provided, the various embodiments of which fulfill one or more of the following objects: ease of construction; low cost of manufacturing; standardization of components; the ability to expand and contract freely without compromising the integrity of the protector; the ability to install the eaves protector without fastening either the soffit or the fascia plate directly to the building; the ability to use the protector with standard siding and soffit parts; the ability to use the protector with soffit that is a flat layer of rollable material; installation on any building without manufacturing most or all of the components to custom specifications; flexibility in shaping the exterior appearance of the protector; and appearance of the protector that is close or identical to that of a wooden eaves. It is to be understood that not every embodiment of the eaves protector will fulfill every objective.

These objectives and others are achieved by providing an eaves protector comprising a fascia plate covering a portion of the outer surface of a fascia board of the eaves, a fascia/soffit lock configured to be fastened to at least one of the fascia board and a soffit board of the eaves, a soffit configured to fit into the outer soffit slot such that the soffit is at least partially supported by the fascia/soffit lock; and a soffit receiver configured to be fastened to at least one of the soffit board, a frieze board, and an exterior wall. The fascia plate comprises a generally vertical fascia cover portion, a lock engagement portion, a central portion between the fascia cover portion and the lock engagement portion, and an upper plate edge along the top margin of the fascia cover portion. The fascia/soffit lock comprises an outer soffit slot, and a fascia plate engagement portion configured to engage the lock engagement portion of the fascia plate covering, such that the fascia/soffit lock at least partially supports the fascia plate when the system is fastened to the eaves. The soffit receiver comprises an inner soffit slot configured to fit the soffit such that the soffit is at least partially supported by the soffit receiver, a siding niche configured to accept a top edge of a piece of siding, connected with and below the inner soffit slot when the system is fastened to the eaves, and a central portion connecting the inner soffit slot to the siding niche.

These objectives and others are achieved by also providing a building comprising the eaves protector. These objectives and others are also achieved by providing a method of installing an eaves protector comprising fastening the eaves protector to a building component selected from the group consisting of: a fascia board, a soffit board, a frieze board, and an exterior wall.

DETAILED DESCRIPTION

Figure 6:
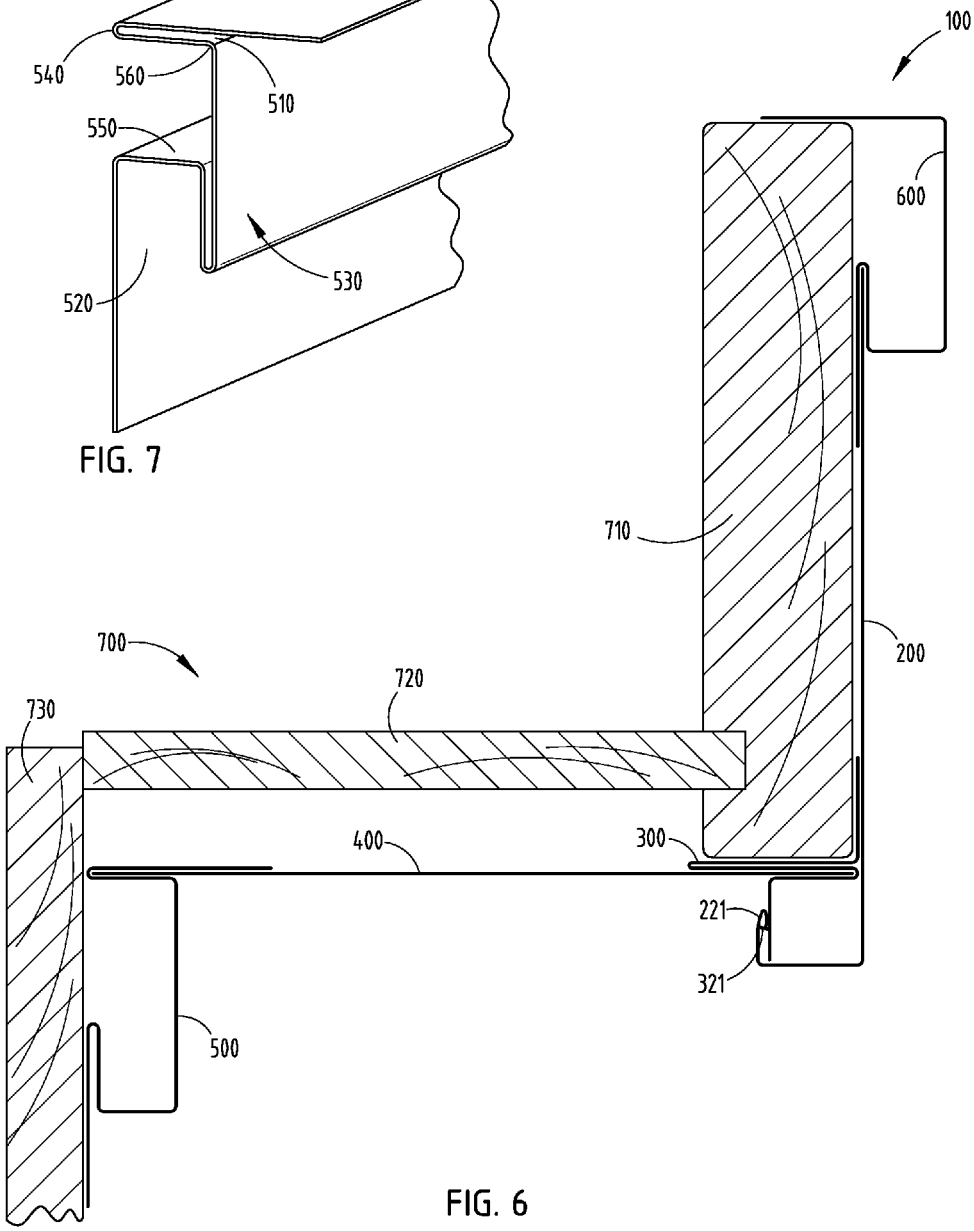
FIG. 6: A diagram illustrating the assembled eaves protector installed on an eaves.

The eaves protector 100 (an embodiment of which is shown in FIG. 6) functions to protect the underlying eaves from various types of weathering. One of the main sources of weathering is exposure to moisture, the main source of moisture being precipitation. To effectively protect the eaves from moisture the eaves protector 100 must present a surface to the elements that is generally impermeable to water. Ideally the eaves protector 100 will be configured to prevent moisture from sheeting over the eaves protector 100 and reaching unprotected parts of the building structure. Protection from moisture damage may also be provided by venting areas of the eaves in which moisture might otherwise accumulate and linger.

Another common source of weathering is solar radiation. Sunlight (which, for the purposes of this discussion, includes non-visible portions of the spectrum such as ultraviolet) can discolor wood, encourage the growth of fouling organisms (such as moss, algae and lichen), discolor paint, and chemically degrade paint.

Another common source of weathering is the freezing of water. Water or moisture that covers or infiltrates parts of the eaves will expand upon freezing. This expansion can damage structures and cause structures that are fastened together to spread apart, generally undermining the integrity of the eaves and the building.

Consequently, it is advantageous to construct the components of the eaves protector 100 from a material (or materials) that has at least one of the following properties: resists damage from water, is impermeable to water, resists damage from sunlight, and can expand or contract without lasting damage. Such materials generally include metals, finished metals, and polymers. Finished metal has the advantage of allowing the use of metals which, if unfinished, might otherwise oxidize or corrode. Finished metal in this context includes galvanized metal, and coated aluminum, which may have a textured wood grain finish that matches other exterior portions of the building. Unfinished metal has the advantage of lower manufacturing cost and greater durability. Polymers have various advantages depending on the polymer material in question. For example, vinyl is a popular material for building exteriors due to its light weight and water resistance.

Figure 1:
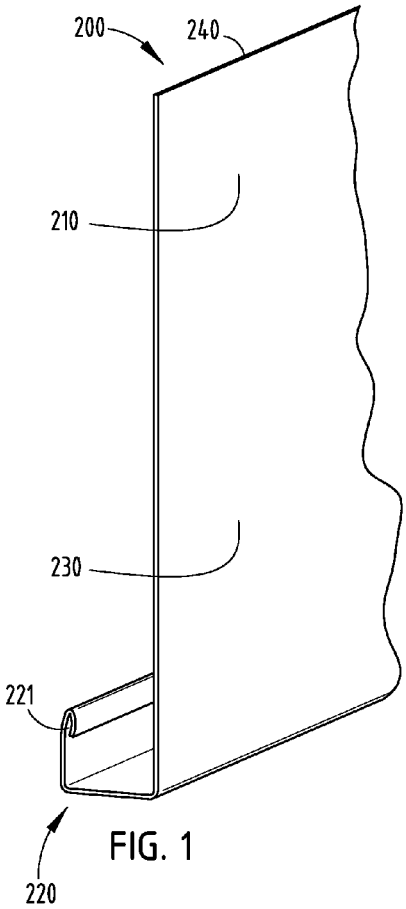
FIG. 1: A diagram illustrating an embodiment of the fascia plate.

The eaves protector 100 comprises a fascia plate 200, an embodiment of which is shown in FIG. 1. The fascia plate 200 serves as a barrier between the elements and the underlying fascia board 710. Because the fascia board 710 is the most exposed portion of the eaves, the fascia plate 200 must provide strong, enduring, and consistent protection from the elements. Consequently, it will be advantageous if the fascia plate 200 is constructed from materials that resist water, are impermeable to water, and resist sunlight. It is also advantageous if the fascia plate 200 may be installed without the use of penetrating fasteners (such as nails or screws), which must form a hole in the protective layer through which moisture can reach the building.

The fascia plate 200 is secured at its lower end by the fascia/soffit lock 300, and may be secured at its upper end by a variety of means. For example, the fascia plate 200 may extend between the roof and the rafter, preventing precipitation from entering the space behind the upper plate edge 240. If the fascia plate 200 extends between the roof and the rafter, fasteners may be put through the portion of the fascia plate 200 that is between the roof and the rafter without allowing moisture to penetrate the fascia plate 200 at the fastener hole (it will be protected by the roof). Extending the fascia plate 200 between the roof and the rafter avoids the need for a fascia drip guard 600.

The fascia plate 200 may also be secured at its upper end by fastening it to the fascia board and placing a drip guard over the area of the fascia plate 200 comprising the fastener hole.

The fascia plate 200 may be secured at its upper end by inserting its upper plate edge 240 into the slot 610 of a fascia drip guard 600, as described more fully below. This configuration has the advantages of securing the fascia plate 200 without driving fasteners through the fascia plate 200, and allows the fascia plate 200 to expand and contract when installed without damaging the eaves protector 100 or compromising the connection between the fascia drip guard 600 and the fascia plate 200.

The fascia plate 200 comprises a generally vertical fascia cover portion 210. The fascia cover portion 210 is defined as that portion of the fascia plate 200 that is positioned between the fascia board 710 and the elements. It is "generally vertical" in that it runs roughly parallel to the fascia board 710; however, the fascia cover portion 210 may take on any geometrical shape so long as it covers the fascia board and covers any fasteners that secure the fascia/soffit lock 300 to the fascia board 710. It is advantageous if the fascia cover portion 210 is geometrically configured to prevent any pooling of water on the interior or the exterior to the fascia plate 200.

The fascia plate 200 further comprises a first snap lock or lock engagement portion 220. The lock engagement portion 220 engages the fascia/soffit lock 300, allowing the fascia plate 200 to be at least partially supported by the lock 300, and permitting longitudinal shifting between fascia plate 200 and fascia/soffit lock 300 due to thermal expansion and contraction. The lock engagement portion 220 can have a variety of shapes. In one embodiment, the lock engagement portion 220 forms a "J" curve at the bottom of the fascia plate 200 that fits snugly around a portion of the fascia/soffit lock 300 (the fascia plate engagement portion 320). A further embodiment comprises a downwardly opening hook at the tip of the "J" that forms a locking lip 221 on the upturned engagement portion 220 that engages one or more locking ridges 321 on the fascia/soffit lock 300. A number of other known configurations of the lock engagement portion 220 and the fascia/soffit lock 300 can be used to secure the fascia plate 200 to the fascia/soffit lock 300, without using separate or penetrating fasteners, which permits longitudinal shifting between fascia plate 200 and fascia/soffit lock 300 due to thermal expansion and contraction.

The portion of the fascia plate 200 that falls between the fascia cover portion 210 and the lock engagement portion 220 may be termed the central portion 230. In those embodiments of the fascia plate comprising an upturned lock engagement portion 220, the central portion 230 may comprise at least one fold to permit the upturned position of the lock engagement portion 220. The central portion 230 may comprise additional features to enhance the functioning and appearance of the eaves protector 100. Some embodiments of the central portion 230 comprise a drip edge (not shown) that prevents sheeting water from reaching the soffit area of the eaves, and can take the form of any downward protuberance that is sufficiently sharp to prevent sheeting water from ascending the back end. Some embodiments of the central portion 230 have a decorative fascia shape that may also serve as a drip edge, although this will not always be the case. An example of a suitable decorative fascia shape is a rectangular shape reminiscent in shape and size to a traditional wooden fascia board.

Figure 2:
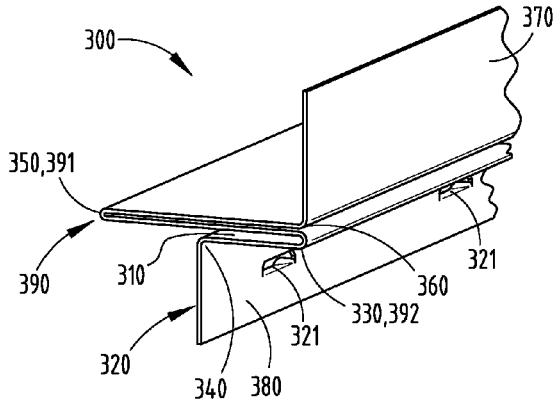
FIG. 2: A diagram illustrating an embodiment of the fascia/soffit lock.

The eaves protector 100 also comprises a fascia/soffit lock 300 (referred to herein as "the lock"), an embodiment of which is shown in FIG. 2. The lock 300 can be fastened to the fascia board 710, the soffit board 720, or both, using conventional fasteners, without creating a conduit for moisture from the exterior elements. If the lock 300 is fastened to the fascia board 710, it is advantageous if the fascia plate 200 covers the fasteners. Many embodiments of the lock 300 will fit on any conventionally configured eaves, and need not be custom manufactured for a particular building.

Figure 2A:
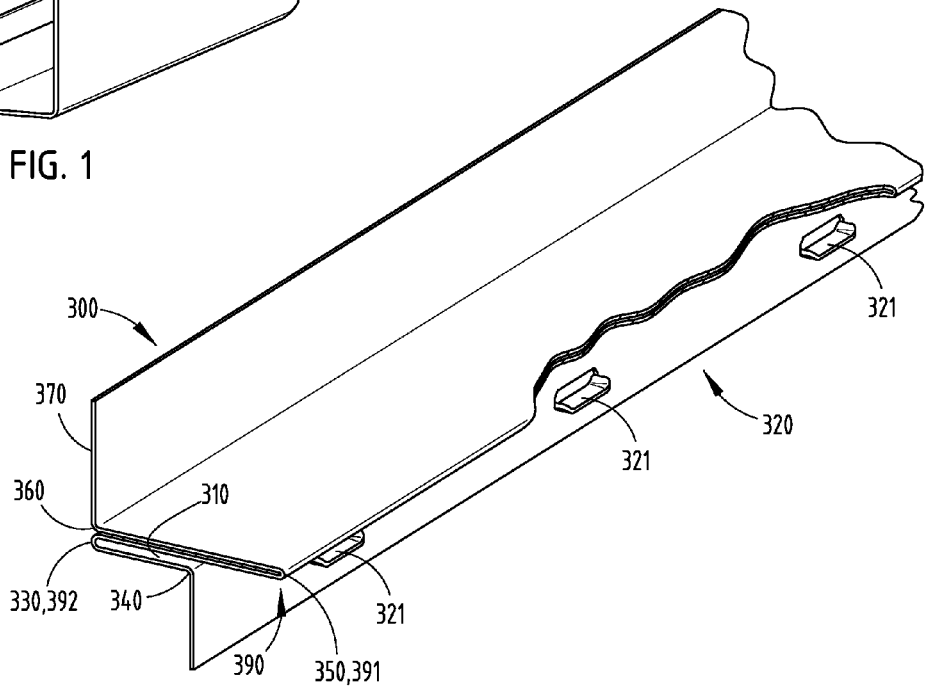
FIG. 2A: A diagram illustrating the fascia/soffit lock of FIG. 2, taken from an opposite side.

The lock 300 comprises an outer soffit slot 310 that accommodates and at least partially supports a soffit panel 400. The lock 300 further comprises a snap lock or fascia plate engagement portion 320 configured to engage the lock engagement portion 220 of the fascia plate 200 covering, such that the fascia/soffit lock 300 at least partially supports the fascia plate 200 when the eaves protector 100 is fastened to the eaves, and permits longitudinal shifting between lock 300 and soffit panel 400 due to thermal expansion and contraction. For example, if the fascia plate lock engagement portion 220 forms a "J" shape, the fascia plate engagement portion 320 may be shaped to fit snugly within the curve of the "J." The fascia plate engagement portion 320 may also comprise a fastening structure to aid in locking and supporting the fascia plate 200, such as one or more locking ridges 321, which can be in the form of pinched tabs that project inwardly and are spaced regularly along lock portion 320, as illustrated in FIGS. 2 and 2A.

Some embodiments of the fascia/soffit lock 300 comprise a single piece of folded material. Constructing the lock 300 from a single piece of folded material has the advantage of great ease of manufacture, as no welds, soldering, or other means of joining parts are necessary. Some materials, such as sheet metal, can be easily folded by a workman on-site, although it will be more economical to construct the lock 300 at a manufacturing facility. As noted above, the lock 300 will function on the eaves of nearly any building, regardless of the building's dimensions or the dimensions of the eaves; as such, on-site modification will rarely be necessary.

One embodiment of the lock 300 that is constructed from a single piece of folded material comprises a first hairpin fold 330 forming the outer soffit slot 310, and a first fold 340 between the outer soffit slot 310 and the fascia plate engagement portion 320. Further embodiments comprise a second hairpin fold 350 adjacent to the first hairpin fold 330 and on the opposite side of the first hairpin fold 330 from the first fold 340, and a second fold 360 on the opposite side of the second hairpin fold 350 from the first fold 340, the second fold 360 forming an upper portion generally parallel to the fascia board. Such embodiments provide excellent attachment for the fascia plate 200 and the soffit panel 400, without using separate or penetrating fasteners, which permits longitudinal shifting between fascia plate 200, lock 300 and soffit panel 400 due to thermal expansion and contraction.

One embodiment of the lock 300 that is constructed from a single piece of folded material comprises an upper tongue 370 configured to sit between the fascia board 710 and the fascia plate 200 when installed on the eaves, a lower tongue 380 that is the fascia plate engagement portion 320 with locking tabs 321; and a sigmoid midsection 390 comprising and upper curve 391 and a lower curve 392, the midsection being between the upper tongue 370 and the lower tongue 380, wherein the lower curve 392 defines the outer soffit slot 310. Such embodiments provide excellent attachment for both the fascia plate 200 and the soffit 400.

The eaves protector 100 comprises a soffit or soffit panel 400. The soffit panel 400 is configured to fit into the outer soffit slot 310 of lock 300 and the inner soffit slot 510 of soffit receiver 500, such that the soffit panel 400 is supported by at least one of the fascia/soffit lock 300 and the soffit receiver 500, without using separate or penetrating fasteners, and permits longitudinal shifting between fascia plate 200, and lock 300, soffit panel 400 and soffit receiver 500 due to thermal expansion and contraction.

The soffit panel 400 may be a conventional prefabricated soffit 400. The soffit panel 400 may also be a generally flat material 401. The material may be rollable. The material must be resistant to weathering, as necessary for any external surface of a building. Examples include sheet metal coil (for example aluminum coil, steel coil, copper coil), and vinyl coil. If the material is metal coil, it may be any commonly commercially available metal coil, such as aluminum, aluminum alloy, copper alloy, aluminum/copper alloy, stainless steel (clad or unclad), and galvalume. Of course, if the material is metal coil, it may be composed of any metal that is generally amenable to coiling and has adequate weathering properties. A soffit 400 that is generally flat rollable material has the advantage of being easily shipped to the site in large continuous lengths, such that the soffit 400 for an entire side of a building can be made from one piece of material by merely cutting a length of coil. This avoids the need to fasten overlapping pieces of soffit 400 together.

The soffit panel 400 may comprise additional features that are conventionally known to enhance their function. For example, some embodiments of the soffit panel 400 are vented by providing slots, holes, or perforations to permit airflow.

Figure 3:
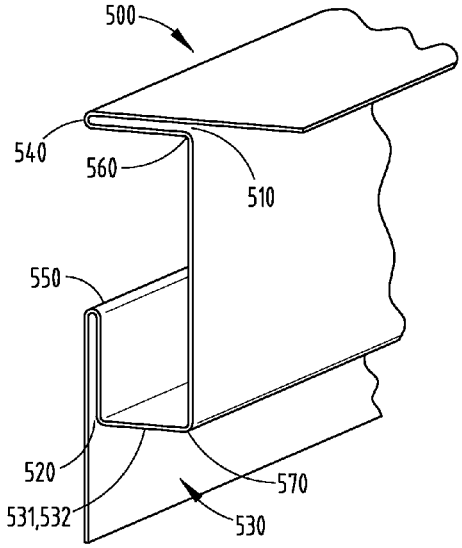
FIG. 3: A diagram illustrating an embodiment of the soffit receiver with a decorative shape resembling a frieze board.
Figure 4:
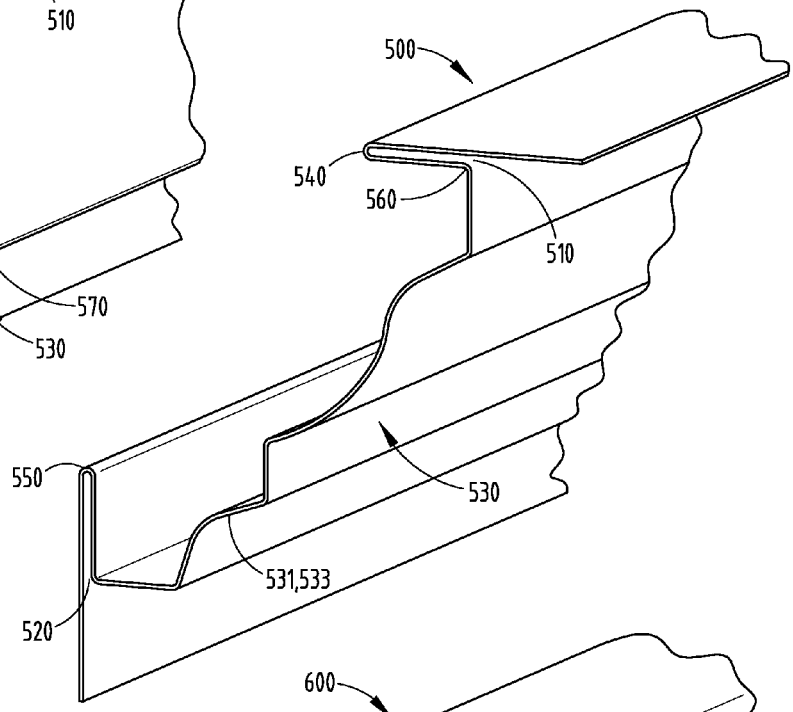
FIG. 4: A diagram illustrating an embodiment of the soffit receiver with a decorative shape resembling crown molding.
Figure 7:
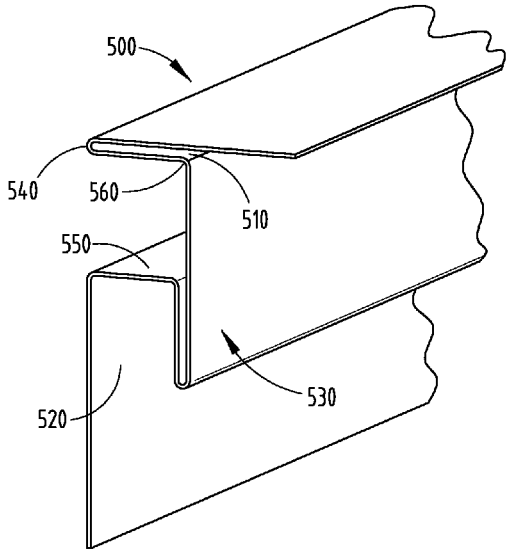
FIG. 7: A diagram illustrating an embodiment of the soffit receiver in which the siding niche is configured to fit builder's grade vinyl siding.

The eaves protector 100 also comprises a soffit receiver 500, embodiments of which are shown in FIGS. 3, 4, and 7. The soffit receiver 500 functions to support the soffit panel 400 on the inner (building) side and to attach the eaves protector 100 to any siding that may be installed on the exterior wall 730 of the building 700. The soffit receiver 500 is fastened to the building 700, generally at one or more of the exterior wall 730, a frieze board, or the soffit board 720. Fastening the receiver 500 to the soffit board has the advantage of having the fastener (and any attendant fastener holes) protected by the soffit panel 400. Fastening the receiver 500 to the frieze board or the exterior wall has the advantage of greater durability, as the weight of the receiver 500 (and the soffit panel 400 which it supports) will not tend to pull the fasteners directly out of the vertical surface to which it is fastened. If the receiver 500 is fastened to the exterior wall, the fasteners will in some cases be covered and protected by siding. In those situations in which the soffit receiver 500 abuts a frieze board, the soffit receiver may further comprise a frieze cap that fits into the siding niche 520 and extends around the bottom of the frieze board in such a way so as to at least partially protect the frieze board from the elements.

Many embodiments of the soffit receiver 500 will fit on any conventionally configured eave, and need not be custom manufactured for a particular building.

The receiver 500 comprises an inner soffit slot 510, into which the soffit panel 400 will fit. The soffit slot 510 is configured to at least partially support the soffit panel 400 when installed on the eaves. Some embodiments of the soffit slot 510 allow the soffit 400 to expand and contract without altering the configuration that allows the soffit slot to keep the soffit 400 in place. For example, one embodiment of the inner soffit slot 510 is a narrow slot with somewhat flexible edges, which allows the soffit panel 400 slight freedom of movement in the direction toward the building or away from the building, without disengaging the soffit 400 panel from the receiver 500. In this, and other embodiments, the inner soffit slot 510 may lack fasteners or fastening structures, as repeated expansion and contraction of the soffit 400 could work the soffit panel 400 free from fasteners or fastening structures.

The dimensions of the soffit slot 510 will be partially dictated by the nature of the soffit panel 400. For example, if the soffit panel 400 is a standard ⅝" panel, the soffit slot 510 may be ⅝" in width or slightly wider to accommodate the panel snugly. As another example, if the soffit panel 400 is 0.125 cm aluminum coil, the soffit slot 510 may be 0.125 cm or slightly wider to accommodate the panel snugly. Generally speaking, the width of soffit slot 510 will be about the same as the thickness of soffit panel 400.

Some embodiments of the receiver 500 further comprise a siding niche 520 configured to accept the top edge of a piece of siding. In this context, the term "siding" means the cladding or covering of the exterior building wall 730 intended to protect the building 700. Siding includes, but is not limited to metal trim coil that is placed over the exterior wall 730 of the building 700. In some embodiments of the eaves protector, the siding is vinyl siding, uPVC weatherboarding, asphalt siding, metal siding, and wood siding. Specific examples of the forgoing include clapboard (wood siding), copper cladding, corrugated galvanized steel, and corrugated aluminum. Because the siding will invariably extend below the soffit panel 400 (and will generally be entirely below the soffit 400), the siding niche 520 will be at least partially below the soffit slot 510, if not entirely below the soffit slot. The dimensions of the siding niche 520 will depend at least partially on the type of siding on the exterior wall 730. For example, if the siding is standard 0.48" vinyl siding, the siding niche 520 will be about 0.48" wide or slightly wider to ensure a snug fit. The siding niche 520 may also have a width that is about equal to the profile height of any standard size of vinyl siding, for example ⅝" or ½." If a simple layer of metal coil or flat siding is used, then the siding niche 520 may be narrower to accommodate the sheet metal without excess space. Generally speaking, the width of the siding niche 520 will be about the same as the thickness of the siding. The receiver 500 need not support the siding, and the siding niche 520 functions mainly to cover the top edge of the siding to improve the appearance of the building and to prevent moisture from entering the space behind the siding.

The portion of the receiver 500 between the siding niche 520 and the inner soffit slot 510 is termed the central portion 530 of the receiver. The central portion 530 may be configured to serve various functions. For example, the central portion 530 of the receiver 500 may be configured to form a drip guard as an extra precaution against moisture entering the space behind the siding or sheeting over the exterior wall 730. The central portion 530 of the receiver 500 may comprise a decorative shape 531. Examples of such decorative shapes 531 include the shape of a frieze board 532 and the shape of a crown molding 533.

Some embodiments of the receiver 500 comprise a single piece of folded material. As is true of the lock 300, constructing the receiver 500 from a single piece of folded material has the advantage of great ease of manufacture, as no welds, soldering, or other means of joining parts are necessary. Some materials, such as sheet metal, can be easily folded by a workman on-site, although it will be more economical to construct the receiver 500 at a manufacturing facility. As noted above, the receiver 500 will function on the eaves of nearly any building, regardless of the building's dimensions or the dimensions of the eaves; as such, on-site modification will rarely be necessary.

Some embodiments of the receiver 500 composed of a single piece of folded material further comprise a hairpin fold 540 forming the inner soffit slot 510, at least one niche fold 550 forming the siding niche 520, an upper fold 560 adjacent to the inner soffit slot 510, and a lower fold 570 adjacent to the siding niche 520, wherein the central portion 530 of the soffit receiver 500 is between the upper fold and the lower fold. Further embodiments of the receiver 500 composed of a single piece of folded material are characterized in that the inner soffit slot 510 is generally perpendicular to the exterior wall 730 of the building 700, and the siding niche 520 is generally parallel to the exterior wall of the building.

Figure 5:
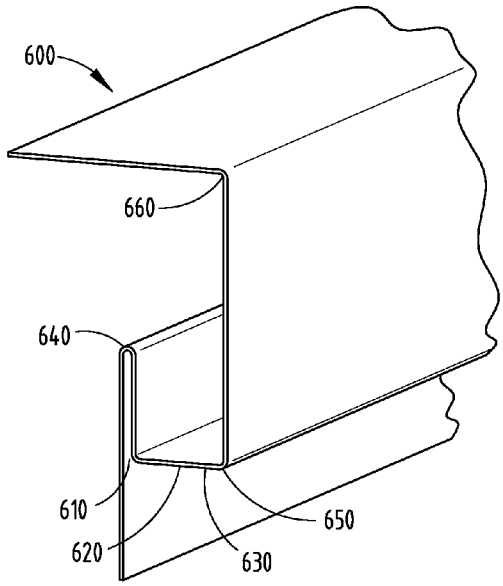
FIG. 5: A diagram illustrating an embodiment of the fascia drip guard.

Some embodiments of the eaves protector 100 further comprise a fascia drip guard 600, an embodiment of which is shown in FIG. 5. The fascia drip guard 600 functions to prevent moisture from entering the space between the fascia plate 200 and the fascia board 710. The fascia drip guard 600 will be fastened to the fascia board 710 in such a way as to avoid the infiltration of moisture behind the fascia drip guard 600. The fascia drip guard 600 may, for example, be fastened to the top side of the fascia board 710, under the roof. Many embodiments of the fascia drip guard 600 will fit on any conventionally configured eaves, and need not be custom manufactured for a particular building.

The illustrated fascia drip guard 600 comprises a fascia plate slot 610 configured to fit the upper plate edge 240 of the face plate. Some embodiments of the fascia plate slot 610 will accommodate the upper plate edge 240 in such a way so as to allow a certain amount of expansion and contraction of the fascia plate 200 without working free of the drip guard or compromising the integrity of the connection between the drip guard and the fascia plate 200. In one such embodiment the fascia plate slot 610 is a narrow channel or fold slightly wider than the fascia plate 200, in which friction between the upper plate edge 240 and the sides of the fascia plate slot 610 keeps the fascia plate 200 in place, although allowing some expansion and contraction of the fascia plate 200.

The fascia drip guard 600 further comprises an upper drip edge 620. The upper drip edge 620 functions to prevent water sheeting off the roof or falling on the side of the fascia drip guard 600 from contacting the fascia plate 200 or entering the space between the fascia plate 200 and the fascia board 710. The upper drip edge 620 can take the form of any downward protuberance that is sufficiently sharp to prevent sheeting water from ascending the back end.

Some embodiments of the fascia drip guard 600 have a decorative upper fascia shape 630; such a decorative upper fascia shape 630 may also serve as an upper drip edge 620, although this will not always be the case. An example of a suitable decorative upper fascia shape 630 is a rectangular shape similar to a top edge of a roof, as it might slightly overhang the fascia.

Some embodiments of the fascia drip guard 600 comprise a single piece of folded material. As for the other components of the eaves protector 100, constructing the receiver 500 from a single piece of folded material has the advantage of great ease of manufacture, as no welds, soldering, or other means of joining parts are necessary. Some materials, such as sheet metal, can be easily folded by a workman on-site, although it will be more economical to construct the drip guard at a manufacturing facility. As noted above, the drip guard 600 will function on the eaves of nearly any building, regardless of the building's dimensions or the dimensions of the eaves; as such, on-site modification will rarely be necessary. Some embodiments of the fascia drip guard 600 composed of a single piece of folded material comprise a hairpin fold 640 forming the fascia plate slot 610. Such embodiments may comprise at least one additional fold 650 defining the upper drip edge 620. Some embodiments further comprise a second additional fold 660 on the opposite side of the upper drip edge 620 from the fascia plate slot 610 such that the drip guard 600 extends between the fascia board and the roof.

The disclosure provides a building 700 comprising any of the eaves protectors 100 disclosed herein. The disclosure also provides methods of installing an eaves protector 100 on a building 700, comprising fastening any component of any eaves protector 100 disclosed herein to at least one building component, including the fascia board 710, the soffit board 720, and the building exterior wall 730. The component of the eaves protector 100 that is fastened to the building 700 may be, for example, the fascia/soffit lock 300, the soffit receiver 500, the fascia drip guard 600, or a combination of any of the foregoing. The eaves protector 100 may also be fastened to the building 700 using any fastener that is conventionally known in the art, so long as the fastener is capable of bearing its portion of the weight of the eaves protector 100.

The foregoing description illustrates and describes the processes, machines, manufactures, compositions of matter, and other teachings of the present disclosure. Additionally, the disclosure shows and describes only certain embodiments of the processes, machines, manufactures, compositions of matter, and other teachings disclosed, but, as mentioned above, it is to be understood that the teachings of the present disclosure are capable of use in various other combinations, modifications, and environments and is capable of changes or modifications within the scope of the teachings as expressed herein, commensurate with the skill and/or knowledge of a person having ordinary skill in the relevant art. The embodiments described hereinabove are further intended to explain certain best modes known of practicing the processes, machines, manufactures, compositions of matter, and other teachings of the present disclosure and to enable others skilled in the art to utilize the teachings of the present disclosure in such, or other, embodiments and with the various modifications required by the particular applications or uses. Accordingly, the processes, machines, manufactures, compositions of matter, and other teachings of the present disclosure are not intended to limit the exact embodiments and examples disclosed herein. In the context of this disclosure the singular is to be read to include the plural and the plural to include the singular unless explicitly stated otherwise. Any female pronoun is to be read to include the male and any male pronoun is to be read to include the singular, unless explicitly stated otherwise. As used herein, the term "including" is meant to be non-limiting, and is to be read as synonymous with "including but not limited to."

The invention claimed is:

1. An eaves protector comprising:

(a) a fascia plate covering a portion of the outer surface of a fascia board of the eaves, the fascia plate comprising:
  (1) a generally vertical fascia cover portion,
  (2) a lock engagement portion,
  (3) a central portion between the fascia cover portion and the lock engagement portion, and
  (4) an upper plate edge along the top margin of the fascia cover portion;

(b) a fascia/soffit lock configured to be fastened to at least one of the fascia board and a soffit board of the eaves, comprising:
  (1) an outer soffit slot, and
  (2) a fascia plate engagement portion configured to engage the lock engagement portion of the fascia plate covering, such that the fascia/soffit lock at least partially supports the fascia plate when the system is fastened to the eaves;

(c) a soffit configured to fit into the outer soffit slot such that the soffit is at least partially supported by the fascia/soffit lock;

(d) a soffit receiver configured to be fastened to at least one of the soffit board, a frieze board, and an exterior wall, the soffit receiver comprising:
  (1) an inner soffit slot configured to fit the soffit such that the soffit is at least partially supported by the soffit receiver,
  (2) a siding niche configured to accept a top edge of a piece of siding, connected with and below the inner soffit slot when the system is fastened to the eaves,
  (3) a central portion connecting the inner soffit slot to the siding niche, and wherein
  (4) the soffit receiver comprises a single piece of folded material comprising a hairpin fold forming the inner soffit slot, at least one niche fold forming the siding niche, an upper fold adjacent to the inner soffit slot, and a lower fold adjacent to the siding niche, wherein the central portion of the soffit receiver is between the upper fold and the lower fold.

2. The eaves protector of claim 1, wherein the central portion of the fascia plate forms a lower drip edge.

3. The eaves protector of claim 1, wherein the central portion of the fascia plate comprises a decorative fascia shape.

4. The eaves protector of claim 3, wherein the decorative fascia shape is the shape of a lower portion of a wooden fascia board.

5. The eaves protector of claim 1, further comprising a fascia drip guard configured to be fastened to the fascia board, comprising:

(a) a fascia plate slot configured to fit the upper plate edge of the fascia plate, and (b) an upper drip edge.

6. The eaves protector of claim 5, wherein the fascia drip guard further comprises a decorative upper fascia shape.

7. The eaves protector of claim 1, wherein the soffit essentially consists of a layer of generally flat material.

8. The eaves protector of claim 7, wherein the material is roll formed from metal.

9. The eaves protector of claim 1, wherein the lock engagement portion of the fascia plate comprises a locking lip, and wherein the fascia plate engagement portion of the fascia/soffit lock comprises a locking ridge configured to fit the locking lip.

10. The eaves protector of claim 1, wherein the central portion of the soffit receiver comprises a decorative frieze shape.

11. The eaves protector of claim 10, wherein the decorative frieze shape is selected from the group consisting of: the shape of a frieze board and the shape of a crown molding.

12. The eaves protector of claim 1, wherein:

(a) the inner soffit slot is generally perpendicular to the exterior wall of the building, and (b) the siding niche is generally parallel to the exterior wall of the building.

13. The eaves protector of claim 1, wherein the fascia/soffit lock comprises a single piece of folded material comprising:

(a) a first hairpin fold forming the outer soffit slot, and (b) a first fold between the outer soffit slot and the fascia plate engagement portion.

14. The eaves protector of claim 13, wherein the fascia/soffit lock further comprises a second hairpin fold adjacent to the first hairpin fold and on the opposite side of the first hairpin fold from the first fold, and a second fold on the opposite side of the second hairpin fold from the first fold, the second fold forming an upper portion generally parallel to the fascia board.

15. The eaves protector of claim 13, wherein the fascia/soffit lock comprises:

(a) an upper tongue configured to sit between the fascia board and the fascia plate when installed on the eaves;

(b) a lower tongue that is the fascia plate engagement portion; and (c) a sigmoid midsection comprising an upper curve and a lower curve, the midsection being between the upper tongue and the lower tongue, wherein the lower curve defines the outer soffit slot.

16. The eaves protector of claim 1, wherein the soffit is configured to fit into at least one of the inner soffit slot and the outer soffit slot to allow some degree of movement of the soffit relative to said at least one of the inner soffit slot and the outer soffit slot.

17. The eaves protector of claim 1, wherein the lock engagement portion is configured to engage the fascia plate engagement portion to allow some degree of movement of the fascia plate relative to the soffit/fascia lock.

18. The eaves protector of claim 5, wherein the fascia plate slot is configured to fit the upper plate edge to allow some degree of movement of the fascia plate relative to the fascia drip guard.

19. A building comprising the eaves protector of claim 1.

20. An eaves protector comprising:

(a) a fascia plate covering a portion of the outer surface of a fascia board of the eaves, comprising:

(1) a generally vertical fascia cover portion, (2) an upturned lock engagement portion comprising a locking lip, and (3) a central portion between the fascia cover portion and the lock engagement portion and comprising at least one fold to permit the upturned position of the lock engagement portion;

(b) a fascia/soffit lock configured to be fastened to at least one of the fascia board and a soffit board of the eaves, comprising:

(1) an upper tongue configured to sit between the fascia board and the fascia plate when installed on the eaves, (2) a lower tongue comprising a locking configuration, and (3) a sigmoid midsection comprising an upper curve and a lower curve, the midsection being between the upper tongue and the lower tongue, wherein the lower curve defines an outer soffit slot;

(c) a soffit configured to fit into the outer soffit slot such that the soffit is at least partially supported by the fascia/soffit lock, the soffit essentially comprising a generally flat layer of material; and (d) a soffit receiver configured to be fastened to at least one of the soffit board, a frieze board, and an exterior wall, the soffit receiver comprising:

(1) a hairpin fold forming an inner soffit slot configured to fit the soffit such that the soffit is at least partially supported by the soffit receiver, (2) a siding niche configured to accept a top edge of a piece of siding, connected with and below the inner soffit slot when the system is fastened to the eaves, and (3) a central portion comprising a decorative frieze shape and connecting the inner soffit slot to the siding niche; wherein the fascia plate, the fascia/soffit lock, and the soffit receiver are each formed from a single piece of folded material.

21. A building comprising the eaves protector of claim 20.

22. An eaves protector, comprising:

(a) a fascia plate shaped to cover at least a portion of a fascia board of the eaves, and including a first snap lock member disposed adjacent a lower portion thereof;

(b) a soffit panel configured to enclose at least a portion of the eaves, and including inner and outer side edges;

(c) a soffit receiver configured to be fastened to at least one of the soffit board, a frieze board, and an exterior wall, and including an inner soffit slot in which the inner edge of the soffit panel is received and at least partially supported without separate fasteners to permit mutual longitudinal shifting between the soffit receiver and the soffit panel due to thermal expansion and contraction;

(d) a fascia/soffit lock comprising:

(1) a first hairpin portion forming an outer soffit slot in which the outer edge of the soffit panel is received and at least partially supported without separate fasteners to permit mutual longitudinal shifting between the fascia/soffit lock and the soffit panel due to thermal expansion and contraction;

(2) a lower tongue portion positioned generally below the first hairpin portion and including a second snap lock member which engages the first snap lock member on the fascia plate to securely interconnect the same without separate fasteners and permit mutual longitudinal shifting between the fascia/soffit lock and the fascia plate due to thermal expansion and contraction; and (3) an upper tongue portion positioned generally above the first hairpin portion, shaped for attachment to the fascia board at a location covered by the fascia plate and supporting the fascia/soffit lock on the fascia board.

23. The eaves protector of claim 22, including:

a fascia drip guard configured to be fastened to the fascia board and having a downwardly opening slot in which an upper portion of the fascia plate is received and retained without separate fasteners to permit mutual longitudinal shifting between the fascia drip guard and the fascia plate due to thermal expansion and contraction.

24. The eaves protector of claim 23, wherein:

the soffit receiver includes a siding niche configured to accept a top edge of a piece of siding, connected with an disposed generally below the inner soffit slot when the eaves protector is fastened to the eaves.

25. The eaves protector of claim 24, wherein:

the fascia/soffit lock comprises a single piece of folded sheet metal.

26. The eaves protector of claim 25, wherein:

the fascia plate comprises a single piece of folded sheet metal.

27. The eaves protector of claim 26, wherein:

the soffit receiver comprises a single piece of folded sheet metal.

28. The eaves protector of claim 27, wherein:

the first snap lock member comprises a downwardly opening, hook shaped locking lip extending along a lower edge of the fascia plate.

29. The eaves protector of claim 28, wherein:

the second snap lock member comprises a plurality of inwardly projecting tabs disposed along a lower portion of the fascia/soffit lock.

30. The eaves protector of claim 22, including:

a fascia drip guard configured to be fastened to the fascia board and having a downwardly opening slot in which an upper portion of the fascia plate is received and retained without separate fasteners to permit mutual longitudinal shifting between the fascia drip guard and the fascia plate due to thermal expansion and contraction.

31. The eaves protector of claim 22, wherein:

the soffit receiver includes a siding niche configured to accept a top edge of a piece of siding, connected with an disposed generally below the inner soffit slot when the eaves protector is fastened to the eaves.

32. The eaves protector of claim 22, wherein:

the fascia/soffit lock comprises a single piece of folded sheet metal.

33. The eaves protector of claim 22, wherein:

the fascia plate comprises a single piece of folded sheet metal.

34. The eaves protector of claim 22, wherein:

the soffit receiver comprises a single piece of folded sheet metal.

35. The eaves protector of claim 22, wherein:

the first snap lock member comprises a downwardly opening, hook shaped locking lip extending along a lower edge of the fascia plate.

36. The eaves protector of claim 22, wherein:

the second snap lock member comprises a plurality of inwardly projecting tabs disposed along a lower portion of the fascia/soffit lock.

37. The eaves protector of claim 22, wherein:

said fascia plate is constructed from sheet aluminum with a textured wood grain finish.

38. The eaves protector of claim 22, wherein:

said soffit panel is constructed from sheet aluminum with a textured wood grain finish.

39. The eaves protector of claim 22, wherein:

said soffit receiver is constructed from sheet aluminum with a textured wood grain finish.

* * * * *